United States Patent [19]
Ikuta et al.
[11] 4,287,866
[45] Sep. 8, 1981

[54] EXHAUST GAS RECIRCULATION SYSTEM FOR INTERNAL COMBUSTION ENGINE

[75] Inventors: Yasuhiro Ikuta; Masashi Matsuo, both of Toyota, Japan

[73] Assignee: Toyota Jidosha Kogyo Kabushiki Kaisha, Toyota, Japan

[21] Appl. No.: 74,764

[22] Filed: Sep. 11, 1979

[30] Foreign Application Priority Data

Jul. 31, 1979 [JP] Japan ..... 54-98492

[51] Int. Cl.[3] ..... F02M 25/06
[52] U.S. Cl. ..... 123/568
[58] Field of Search ..... 123/568

[56] References Cited

U.S. PATENT DOCUMENTS

| | | | |
|---|---|---|---|
| 4,112,894 | 9/1978 | Nohira | 123/568 |
| 4,158,351 | 6/1979 | Ando et al. | 123/568 |
| 4,180,035 | 12/1979 | Saiki et al. | 123/568 |
| 4,192,264 | 3/1980 | Arnaud | 123/568 |
| 4,196,766 | 4/1980 | Kohama et al. | 123/568 |

*Primary Examiner*—Wendell E. Burns
*Attorney, Agent, or Firm*—Cushman, Darby & Cushman

[57] ABSTRACT

An exhaust gas recirculation system for an internal combustion engine has an exhaust gas recirculation passage, a constant pressure chamber disposed in the exhaust gas recirculation passage, a pressure regulating valve operative in response to the exhaust gas pressure in the constant pressure chamber, a first flow-rate control valve adapted to be actuated by the vacuum regulated by the pressure regulating valve so as to open and close the exhaust gas recirculating passage and a second flow-rate control valve disposed at the upstream side of the constant pressure chamber and adapted to change the cross-sectional area of the exhaust gas recirculating passage in response to the vacuum generated by the internal combustion engine. The exhaust gas recirculation system further has an atmospheric-pressure introduction passage attached to the constant pressure chamber or disposed in a pressure transmitting passage through which the constant pressure chamber is communicated with the pressure regulating valve. The atmospheric-pressure introduction valve is adapted to open in response to an increase of the level of the vacuum in the constant pressure chamber or in the pressure transmitting passage, so as to selectively introduce the atmospheric pressure.

6 Claims, 3 Drawing Figures

EXHAUST GAS RECIRCULATION SYSTEM FOR INTERNAL COMBUSTION ENGINE

BACKGROUND OF THE INVENTION

The present invention relates to an exhaust gas recirculation system (referred to as "EGR system", hereinafter) and, more particularly, to an improvement in the EGR device having a first flow-rate control valve adapted for opening and closing an EGR passage in accordance with the pressure in a constant pressure chamber disposed in the EGR passage and a second flow-rate control valve adapted to change the cross-sectional area of the EGR passage in accordance with the load applied to the engine.

An EGR system has been known which includes a first and a second flow-rate control valves disposed in the EGR passage for changing the EGR ratio (ratio of flow rate of recirculated exhaust gas to the flow rate of the intake air) so as to effectively suppress the emission of the noxious NOx over the whole range of engine operation and to improve the drivability of the vehicle, as well as to reduce the fuel consumption. In this known system, however, a diaphragm, which defines an exhaust gas pressure chamber of a pressure regulating valve to which the exhaust pressure in the constant pressure chamber is introduced, is inconveniently inversed from the normal set position, when the engine is decelerated from the state of heavy load operation. This undesirable hinders the required EGR function and seriously deteriorate the durability of the diaphragm.

This undesirable inversion of the diaphragm is attributable to a delay of operation of the first flow-rate control valve due to a length of the vacuum passage between the vacuum chamber of the first flow-rate control valve and the vacuum pick-up port (referred to as EGR port) of the carburetor, and also to the presence of an orifice in the pressure regulating valve disposed in the above-mentioned vacuum passage.

More specifically, for decelerating the engine, the throttle valve of the carburetor, which has been widely opened, is closed almost to the fully closed position. As a result, the pressure at the EGR port is increased to the level of the atmospheric pressure. However, the pressure in the vacuum chamber of the first flow-rate control valve is not increased to the atmospheric pressure immediately after the closing of the throttle valve. Thus, the increase of the pressure in the vacuum chamber of the first flow-rate control valve lags behind the increase of the pressure at the EGR port. Consequently, the closing operation of the first flow-rate control valve is made at a time lag of an order of about 0.5 second. In consequence, a high vacuum of about −600 mmHg in the intake manifold caused by the full closing of the throttle valve is transmitted through the EGR passage and the constant pressure chamber to the diaphragm of the pressure regulating valve to invert the diaphragm.

FIG. 2 shows the characteristics such as the change in pressure in the constant pressure chamber as observed in an engine racing test on an assumption that the engine is decelerated from the state of heavy load operation. More specifically, a full-line curve A shows the change of the vacuum in the intake manifold, while a broken line B shows the change of pressure in the constant pressure chamber.

The hatched region defined by the broken line represents the increase of the vacuum level in the constant pressure chamber which incurs the inversion of the diaphragm of the pressure regulating valve. The change of the engine operation speed under above-mentioned condition is shown by two-dot-and-dash line C.

In order to overcome the above-explained problem of the prior art, it has been attempted to delay the closing of the second flow-rate control valve under the above-stated condition of operation, or to increase the diameter of a fixed restriction or orifice which is disposed in parallel with the second flow-rate control valve, thereby to release the vacuum in the constant pressure chamber, which is represented by the hatched area in FIG. 2, to the exhaust manifold. This measure, however, cannot provide a satisfactory result, although it is effective to lower the peak level of the vacuum by a small extent.

SUMMARY OF THE INVENTION

Under these circumstances, the invention aims at overcoming the above-stated problem of the prior art.

It is, therefore, an object of the invention to prevent the undesirable inversion of the diaphragm of the pressure regulating valve, when the engine is decelerated from the state of heavy load operation, to preserve the correct operation of the EGR system and, at the same time, to improve the durability of the diaphragm, thereby to ensure a stable exhaust gas cleaning function for a long period of time.

To this end, according to the invention, there is provided an EGR system having a first flow-rate control valve which is actuated by a vacuum regulated by a pressure regulating valve which operates in response to the exhaust gas pressure in a constant pressure chamber disposed in the EGR passage, and a second flow-rate control valve adapted to change the cross-sectional area of the EGR passage in response to the load applied to the engine, wherein the improvement comprises an atmospheric-pressure introduction valve disposed in the constant pressure chamber or in a pressure transmitting passage extending between the constant pressure chamber and the pressure regulating valve, the atmospheric-pressure introduction valve being adapted to open upon detection of an increase of the vacuum in the constant pressure chamber or in the pressure transmitting passage, thereby to prevent the rise of the vacuum acting on the diaphragm of the pressure regulating valve.

It is therefore possible to suppress the increase of level of the vacuum in the pressure transmitting passage, when the engine is decelerated from the state of heavy load operation, thereby to prevent the undesirable inversion of the diaphragm.

The above and other objects, as well as advantageous features of the invention will become more clear from the following description of the preferred embodiments taken in conjunction with the accompanying drawings.

DESCRIPTION OF THE PREFERRED EMBODIMENTS

The invention will be more fully understood from the following description.

Figure 1:
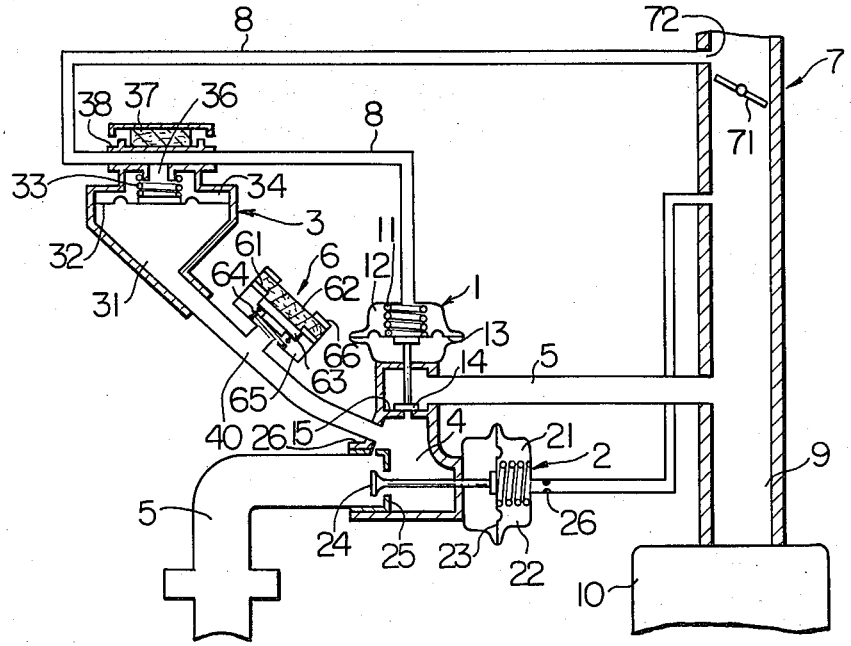
FIG. 1 is a schematic illustration of an EGR system embodying the present invention.

Referring first to FIG. 1 schematically showing an EGR system embodying the present invention, an EGR passage 5 is adapted to recirculate a part of the exhaust gas discharged from an exhaust manifold (not shown) to an intake manifold 9. A constant pressure chamber 4 is disposed at an intermediate part of the EGR passage 5. A first flow-rate control valve 1 is disposed also in the EGR passage 5. This first flow-rate control valve 1 has a vacuum chamber 12 defined partly by a diaphragm 13 which is opposed by a spring 11. The arrangement is such that the diaphragm is deflected to a position where the force of the spring 11 is balanced by the force of the pressure acting on the diaphragm 13, so that a valve 14 attached to the diaphragm 13 is moved toward and away from a valve seal to control the flow rate of the exhaust gas which is recirculated through the EGR passage 5. A pressure regulating valve 3 is disposed at an intermediate portion of a vacuum passage 8 through which the vacuum chamber 12 communicates with an EGR port 72 of a carburetor 7. The EGR port 72 opens to the inside of the intake bore of the carburetor 7 at a portion of the latter immediately above the throttle valve 71 in the fully closed position. The pressure regulating valve 3 has an exhaust gas pressure chamber 31 defined by a diaphragm 32 and adapted to receive the exhaust gas pressure derived from the above-mentioned constant pressure chamber 4, and an atmospheric chamber 34 accommodating a spring 33 and communicated with the atmosphere through a filter 37.

The arrangement is such that a valve 35 attached to the diaphragm 32 is moved in response to the change in the level of the exhaust gas pressure chamber 31 to open and close a valve port 36 so that the atmospheric air is introduced selectively to regulate the level of the vacuum in the vacuum chamber 12. Thus, the first flow-rate control valve 1 is actuated to vary the opening degree of the valve 14, by the vacuum the level of which is regulated by the pressure regulating valve 3 which in turn operates in response to the exhaust gas pressure residing in the constant pressure chamber. In consequence, the pressure in the constant pressure chamber 4 is maintained substantially at the same level as the atmospheric pressure to permit the recirculation of the exhaust gas at a rate substantially proportional to the flow-rate of the intake air.

A second flow-rate control valve 2 is disposed at the upstream side of the constant pressure chamber 4. This second flow-rate control valve has a vacuum chamber 22 accommodating a spring 21 and partly defined by a diaphragm 23 to which a valve 24 is attached. The valve 24 is adapted to cooperate with a valve seat 25. The arrangement is such that the diaphragm 23 is deflected in response to the vacuum applied to the vacuum chamber 22 so that the opening area of the valve seat 25 is changed in inverse proportion to the level of the vacuum applied to the vacuum chamber 22. A fixed orifice 26 is disposed in parallel with the valve seat 25.

Thus, the second flow-rate control valve 2 controls the flow rate of the exhaust gas recirculated to the intake side, by changing the total cross-sectional area of the passage which is the sum of the opening cross-sectional area of the fixed orifice 26 and the opening cross-sectional area of the valve seat 25 determined by the position of the valve 24.

An atmospheric-pressure introduction valve 6 is disposed in a pressure transmitting passage 40 through which the exhaust gas pressure chamber 31 of the pressure regulating valve 3 communicates with the constant pressure chamber 4. This valve 6 is a one-way valve having a pressure chamber 65 communicatable with the atmosphere through an atmospheric port 66 of a valve seat 61 provided with an air filter 62. The pressure chamber 65 accommodates a valve 63 which is normally biased by a spring 64 in the direction for closing the port 66. Thus, the atmospheric-pressure introduction valve 6 is opened upon detection of an increase of the level of vacuum in the pressure transmitting conduit 40, which vacuum being transmitted to the pressure chamber 65, so as to selectively introduce the atmospheric pressure into the pressure transmitting passage 40, thereby to make the level of the vacuum acting in the exhaust gas pressure chamber 31 adjustable.

The EGR system of the invention constructed as above operates in a manner described hereinunder.

During a heavy load operation of the engine in which the throttle valve 71 is largely opened, the level of the vacuum established in the intake manifold 9 is comparatively low and a comparatively high exhaust pressure is applied to the constant pressure chamber 4 and the pressure transmitting passage 40, so that the valve 63 of the atmospheric-pressure introduction valve 6 is biased by the spring 61 to close the atmospheric port 66 to interrupt the admission of atmospheric air into the pressure transmitting passage 40. In this state, the opening degree of the first flow-rate control valve 1 is under the control of the exhaust gas pressure residing in the constant pressure chamber 4, while the opening degree of the second flow-rate control valve 2 is under the control of the vacuum level in the intake manifold 9, so that the exhaust gas is recirculated from the exhaust manifold to the intake manifold, as known per se, at an EGR ratio which is determined in accordance with the level of the load applied to the engine.

As the engine is decelerated from this state by a closing of the throttle valve 71 almost to the fully-closed position, the pressure at the EGR port 72 is increased to the atmospheric pressure, while the transmission of the atmospheric pressure to the vacuum chamber 12 of the first flow-rate control valve 1 is somewhat delayed due to the presence of the orifice 38 attached to the pressure regulating valve 3 and so forth.

In consequence, the closing of the first flow-rate control valve 1 is delayed to permit the transmission of the high vacuum, which has been generated in the intake manifold due to the full closing of the throttle valve 71, to the pressure transmitting passage 40 through the port of the valve seat 14 and the constant pressure chamber 4. As the vacuum in the pressure transmitting passage 40 exceeds a predetermined level, the valve 63 is moved to open the port 66 of the valve seat 61, overcoming the biasing force of the spring 64, thereby to introduce the atmospheric pressure into the pressure transmitting passage 40. Thus, the atmospheric-pressure introduction valve 6 transmits the atmospheric pressure through the pressure transmitting passage 40 to the pressure chamber 31 without delay to suppress the rise of the vacuum, thereby to prevent the undesirable inversion of the diaphragm 32. Meanwhile, the vacuum of increased level in the intake manifold 9 is transmitted through the orifice 26 and so forth to displace the valve 24 toward the valve seat 25 so as to reduce the opening area of the port in the valve seat. However, in the described embodiment, the atmospheric pressure introduced into the pressure transmitting passage 40 is transmitted also to the constant pressure chamber 4, so that the problem inherent in the conventional system attributable to the prevention of relief of the vacuum in the constant pressure chamber is fairly avoided.

Figure 2:
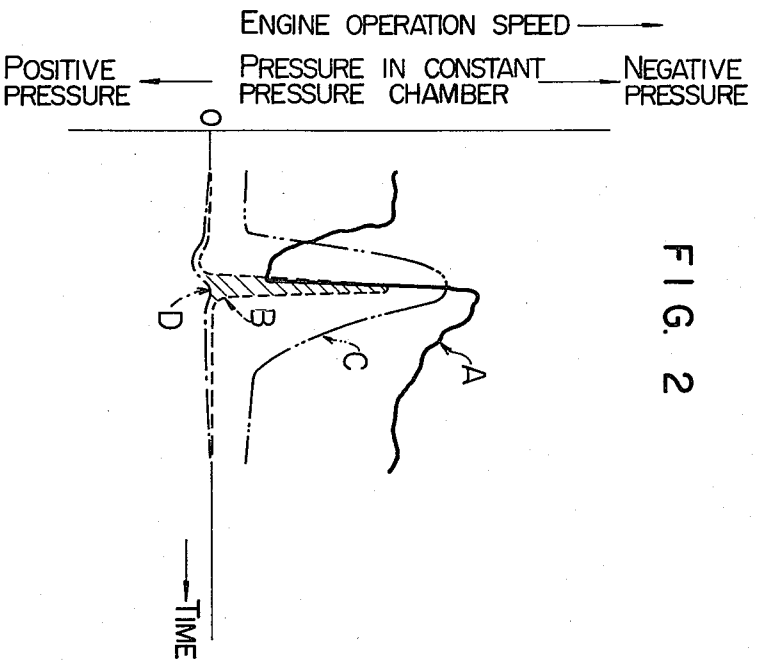
FIG. 2 is a characteristic chart showing the change of the pressure in a constant pressure chamber, as well as the change of the engine speed, as observed in a racing test of an engine.

Referring now to FIG. 2, a one-dot-and-dash line D shows the change of the pressure in the constant pressure chamber 4 of the EGR system in accordance with the present invention. It will be seen that the rise of the vacuum level represented by the aforementioned hatched area is effectively suppressed in the EGR system of this embodiment.

In the described embodiment, the spring 64 of the atmospheric-pressure introduction valve 6 can be set at any desired pressure, in accordance with the level of the vacuum which would cause an inversion of the diaphragm 32.

Figure 3:
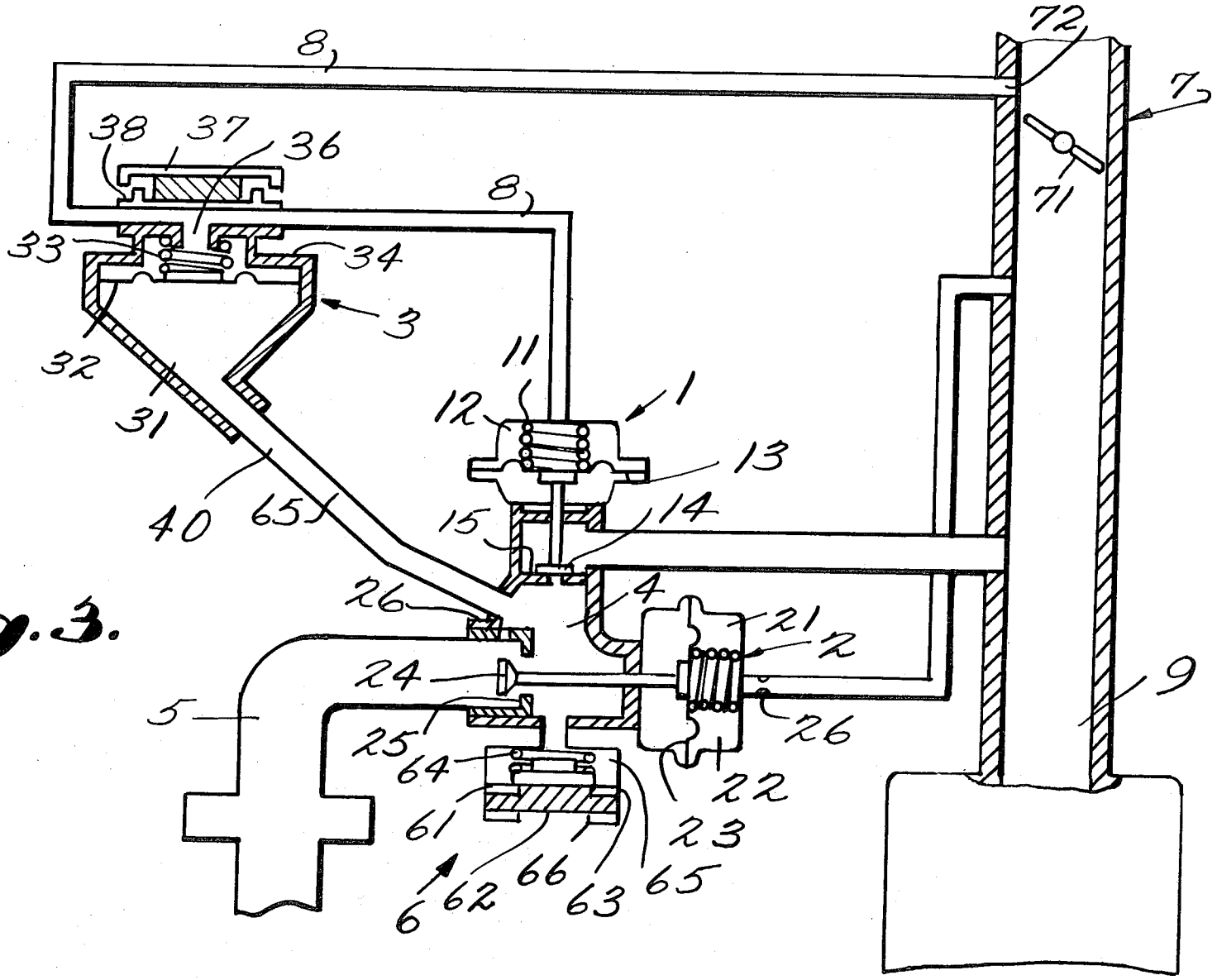
FIG. 3 is a schematic illustration of another embodiment of an EGR system in accordance with the present invention.

It is also possible to provide the atmospheric-pressure introduction valve 6 directly on the constant pressure chamber 4, insteadly of the intermediate portion of the pressure transmitting passage 40, without departing from the spirit of the invention. In such a case, the atmospheric-pressure introduction passage operates upon detect of the level of the vacuum in the constant pressure chamber 4. This embodiment is illustrated in FIG. 3.

What is claimed is:

1. An exhaust gas recirculation system for an internal combustion engine comprising:

an exhaust gas recirculation passage, a constant pressure chamber defined in said exhaust gas recirculation passage, a pressure regulating valve communicating with said control pressure chamber through a pressure transmitting passage operative in response to the exhaust gas pressure in said constant pressure chamber, a first flow-rate control valve responsive to vacuum regulated by said pressure regulating valve for opening and closing said exhaust gas recirculation passage, a second flow-rate control valve disposed at the upstream side of said constant pressure chamber for changing the cross-sectional area of said exhaust recirculation passage in response to the vacuum generated by said engine, and an atmospheric-pressure introduction valve for introducing atmospheric pressure into said pressure transmitting passage in accordance with the increase of the level of vacuum in at least one of said constant pressure chambers and said pressure transmitting passage.

2. An exhaust gas recirculation system as claimed in claim 1, wherein said atmospheric-pressure introduction valve is disposed on said constant pressure chamber for operating in response to the increase of level of vacuum in said constant pressure chamber.

3. An exhaust gas recirculation system as claimed in claim 1, wherein said atmospheric-pressure introduction valve is disposed in said pressure transmitting passage for operating in response to the increase of level of vacuum in said pressure transmitting passage.

4. An exhaust gas recirculation system for an internal combustion engine including a carburetor providing variable intake bore pressure, an intake manifold providing variable intake manifold pressure, and an exhaust manifold providing exhaust gas of variable pressure, said system comprising:

an exhaust gas recirculation passage having a pressure chamber defined therein;

first flow rate control means responsive to a control pressure for controlling the flow rate of exhaust gas from said pressure chamber;

second flow rate control means responsive to said intake manifold pressure for controlling the flow rate of said exhaust gas into said pressure chamber;

regulating means responsive to pressure applied thereto for obtaining said control pressure from said intake bore pressure; and means responsive to pressure in said pressure chamber for providing atmospheric pressure to said regulating means when pressure in said pressure chamber falls beyond a predetermined value, said regulating means otherwise being responsive to pressure applied thereto from said pressure chamber.

5. A system as in claim 4, wherein said atmospheric pressure providing means is connected to said pressure chamber for introducing atmospheric pressure thereto when pressure therein falls beyond said predetermined value, atmospheric pressure thereby being provided to said regulating means.

6. A system as in claim 4 further comprising a pressure transmitting passage for connecting said regulating means and said pressure chamber, said atmospheric pressure providing means being connected to said pressure transmitting passage for introducing atmospheric pressure thereto when pressure therein falls beyond said predetermined value in response to pressure in said pressure chamber, atmospheric pressure thereby being provided to said regulating means.

* * * * *